US006318505B1

(12) United States Patent
De Angelis

(10) Patent No.: US 6,318,505 B1
(45) Date of Patent: Nov. 20, 2001

(54) DEVICE AND METHOD FOR PREVENTING VERTICAL DISPLACEMENTS AND VERTICAL VIBRATIONS OF THE LOAD CARRYING MEANS OF VERTICAL CONVEYORS

(75) Inventor: Claudio De Angelis, Lucerne (CH)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 09/598,352

(22) Filed: Jun. 21, 2000

(30) Foreign Application Priority Data

Jun. 25, 1999 (EP) ..... 99810561

(51) Int. Cl.[7] ..... B66B 1/34
(52) U.S. Cl. ..... 187/292; 187/359
(58) Field of Search ..... 187/292, 359, 187/367, 366, 374, 375, 370, 351; 188/41, 43, 44, 166, 167, 171, 173

(56) References Cited

U.S. PATENT DOCUMENTS 3,554,327 * 1/1971 Takamura et al. ..... 188/83
3,918,552 * 11/1975 Kameyama et al. .
4,234,063 * 11/1980 Blake .
4,337,848 * 7/1982 Kinder ..... 187/29 R
4,805,740 * 2/1989 Wilke et al. ..... 188/173
5,014,828 * 5/1991 Baldassarre .
5,038,605 * 8/1991 Tews et al. ..... 73/129
5,120,023 * 6/1992 Kawabata ..... 187/115
5,233,139 * 8/1993 Hofmann .
5,377,296 * 12/1994 Greenway et al. .
5,424,498 * 6/1995 Spielbauer et al. ..... 187/292
5,518,087 * 5/1996 Hwang et al. ..... 187/374
5,648,644 * 7/1997 Nagel .
5,739,610 * 4/1998 Nemoto et al. ..... 188/158
5,819,879 * 10/1998 Lang et al. ..... 187/376
6,021,872 * 2/2000 Sevilleja et al. ..... 187/350
6,053,287 * 4/2000 Weinberger et al. ..... 187/370

FOREIGN PATENT DOCUMENTS

2839160 * 3/1980 (DE) .
2932485 * 3/1981 (DE) .
183616 * 6/1986 (EP) .
346195 * 12/1989 (EP) .

* cited by examiner

*Primary Examiner*—Jonathan Salata
(74) *Attorney, Agent, or Firm*—MacMillan, Sobanski & Todd, LLC

(57) ABSTRACT

A braking device for load carrying cars in vertical conveyor installations with elastic suspension apparatus holds fast to guiderails to prevent vertical displacements and vertical vibrations while stopped at landings. The braking device contains integrated sensors for registering the holding forces occurring between the load carrying car and the guiderails. Before travel of the car continues, the signals from these sensors enable a drive regulator to adjust via a drive unit the tensile force in the suspension apparatus carrying the car in such a manner that the braking device is relieved and can be opened without generating a jerk on the load carrying car.

12 Claims, 3 Drawing Sheets

DEVICE AND METHOD FOR PREVENTING VERTICAL DISPLACEMENTS AND VERTICAL VIBRATIONS OF THE LOAD CARRYING MEANS OF VERTICAL CONVEYORS

BACKGROUND OF THE INVENTION

The present invention relates to a device and a method for preventing vertical displacements and vertical vibrations of the load carrying means of vertical conveyors while they are stopped at landings, achieving the desired effect by the load carrying means being held fast on its guiderails during landing stops by means of frictional engagement, this frictional engagement being released in the presence of a corresponding control command.

The following description relates to passenger- or freight-elevators that represent a special type of vertical conveyors. The designation of the components therefore corresponds to the technical terms of the elevator field. For example, the load carrying means is designated as elevator car or car.

The European patent 0 346 195 discloses an electromagnetically actuated caliper which is designed inter alia to bind the car or counterweight of an elevator to its respective guiderail by means of frictional engagement. The brake has two double-arm levers with a common joint at their midpoint whose shaft is fastened to the car or counterweight. The gripping arms of the levers are lined with brake linings and embrace the tongue of the guiderail of the car or counterweight. The opposite, driving arms of the levers are held apart by a compression spring which gives rise to the gripping force between the brake linings and the tongue of the guiderail at the other end of the levers. Concentric to the compression spring which pushes the ends apart there is a pull-type electromagnet which, when current flows through it, overcomes the force of the compression spring and thereby opens the brake.

The disclosed braking device is particularly intended as a holding brake for counterweights or cars of elevators driven by linear motors, and the patent claims relate mainly to the embodiment of an integral damping element to prevent switching jolts and switching noises being caused by the pull-type magnet.

In elevator installations with large travel heights, cars hanging on suspension means such as, for example, wire ropes or flat belts have the disadvantage that when stopping at a landing they undergo relatively large vertical displacements whose cause is the stretching or contraction of the elastic suspension means due to changes in load. Such changes in load in the car are caused by passengers entering or leaving, or by transportation equipment being put into or taken out of the car. If the vertical displacements exceed a variable limit value, the drive usually executes a compensating movement until the surfaces of the car floor and landing floor are again at the same level. Depending on the type of change in load, several such compensating procedures may be necessary during a stop at a landing.

Furthermore, while stopped at a landing, such elevator cars are susceptible to vertical vibrations caused by the stopping process, changes in load, or the level-compensating procedures described above. Vertical displacements and vibrations of the car can cause passengers to experience unpleasant sensations or even alarm. Moreover, if the surfaces of the car floor and hoistway door sill are not at exactly the same level, this can lead to accidents caused by passengers stumbling as they enter or leave the car.

The situation described can be improved by holding the elevator car fast on its guiderails by frictional engagement.

SUMMARY OF THE INVENTION

The purpose of the present invention is to create a car braking device which solves the problems concerning vertical displacement and car vibrations described above without impairing the quality of ride, and particularly without causing a jerk when the brake opens for the car to continue its travel.

To ensure that there is no jerk when travel commences, when using a car braking device for the purpose described, the car-side suspension means (suspension ropes, suspension and driving belts, or similar elements) should be pre-tensioned to the load which will occur after the brake is opened, which is the case if a drive unit which can be regulated with respect to torque and rotational speed pre-tensions the car-side suspension means via the traction sheave each time before travel commences, so that the braking device is completely relieved before it is opened. For optimal fulfillment of this requirement the drive regulator must have suitable information concerning the load status on the car braking device.

Measuring the holding forces directly on the car braking device is advantageous because this makes it possible to register and compensate the holding forces actually present and because all indirect methods of relieving the brakes are subject to a number of sources of error.

Installation and use of the car braking device with integrated registering of the holding forces according to the invention has a number of important advantages. The first is that perfect relief of the brake before further travel commences is not effected by a pre-tensioning torque being generated by regulation of the drive unit and calculated from the torque registered when stopping and the difference in load measured during the landing stop; instead, it is effected by this torque being continuously increased by the drive unit before travel commences until a measuring bridge formed by the load-measuring sensors of the car braking device is in balance, i.e. the car braking device is perfectly relieved. With this method, deviations due to frictional effects, or resulting from errors in measuring the load in the car, and from inaccuracies in generating a torque corresponding to a calculated reference value, are ruled out.

Secondly, its use makes it possible to dispense with the relatively costly measurement of the load in the car, because the load in the car can be sufficiently accurately calculated from the torque on the drive unit before stopping and the change in load on the car braking device during the landing stop, the weights of the car, counterweight, and—depending on the position of the car—ropes being included in this calculation.

Thirdly, the car braking device according to the invention can replace the usual holding brake on the drive unit, although operation with both braking devices is possible.

Because the car braking device registers the holding forces in the upward and downward direction, the regulable drive unit has enough information available in all possible load situations to completely relieve the car braking device before travel continues and thereby to enable jerk-free starting. Registering the holding forces in the upward and downward direction is necessary for two reasons. If the elevator is operated with a holding brake on the drive unit, the car braking unit is loaded in opposite directions depending on whether passengers enter or leave. If operation is without a holding brake on the drive unit, the direction of load on the car braking device depends on whether the weight of the car and its momentary load is greater or less than that of the counterweight.

Integration of the measuring elements into the car braking device itself permits this device to be fastened onto the car in a simple, sandwich-like manner in combination with other car components, and to be electrically connected without problem.

Actuation of the brake levers of the car braking device by a stroke-imparting mechanism acting via a toggle mechanism has the advantage that the force of the stroke-imparting mechanism is amplified many times by simple means, and that in the braked status a continuation of the holding force of the stroke-imparting mechanism is not required. For this reason, and even taking account of power outages, stroke-imparting mechanisms can be used which have no pre-tensioned springs and operate with briefly activated closing and opening strokes such as, for example, a solenoid acting in both directions and having limited switch-on time.

An important advantage of this invention is that in the future, when use is made of suspension means made of synthetic fibers (e.g. aramide fiber ropes or flat belts), the problems in relation to vertical displacements and vibrations during stops at landings which are then expected to occur to a greater extent can be avoided by using the car braking device according to the invention.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
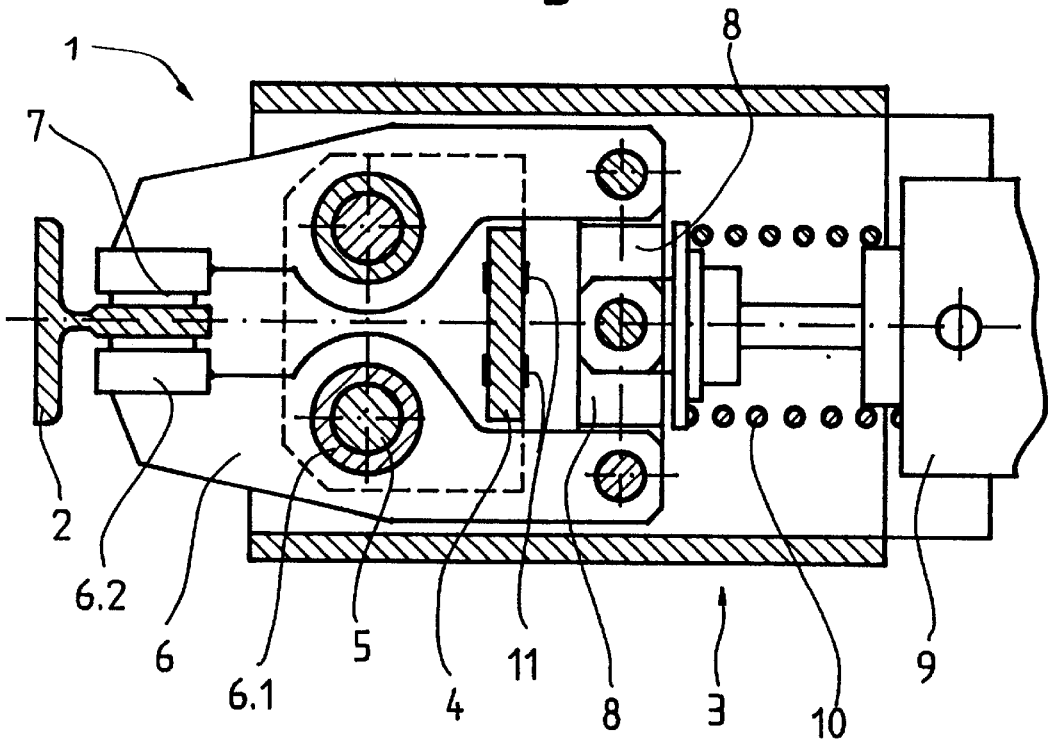
FIG. 1 is a top plan view in cross-section showing the construction of a car braking device according to the present invention, and its interaction with a guiderail.

FIG. 1 shows a plan view of a car braking device 1 according to the present invention. Recognizable on the left is a guiderail 2 of the sort normally used in elevator construction and on which the braking device acts.

The car braking device 1 consists essentially of a rectangular block-shaped casing which has fixed inside it a brake arm support 4 with two brake arm swivel bolts 5. Each bolt 5 has a brake arm 6 rotatably mounted thereon at a brake arm hub 6.1. An end of each brake arm 6 has an attached brake shoe 6.2 facing opposite sides of a braking surface of the guiderail 2. Mounted on each brake shoe 6.2 is a brake lining 7 for frictionally engaging the guiderail 2. A toggle mechanism 8 is connected between the arms 6 and a stroke-imparting device 9 taking the form of a solenoid, a hydraulic cylinder, or a spindle motor. A compression spring 10 is positioned to force the toggle mechanism 8 to engage the brake linings 7 with the guiderail 2 while the stroke-imparting device 9 can be actuated to release the linings from engagement. The car braking device 1 also has wire-resistance strain gages 11 mounted on the brake arm support with which the holding forces of the brake levers 6 are registered.

The holding effect of the car braking device 1 is achieved by the compression spring 10 acting via the toggle mechanism 8 to push the brake arms 6, which are pivoted on the brake arm swivel bolts 5, apart thereby pressing the brake ends of the arms together and the brake linings 7 against the running surface of the guiderail 2. In the process, the toggle mechanism 8 greatly amplifies the force of the spring 10. The position of the car braking device 1 shown in the drawing corresponds to the situation in which it holds the car fast on the guiderails 2 by means of frictional engagement. The car braking device 1 is released by the controllable stroke-imparting mechanism 9 overcoming the pre-tensioned force of the compression spring 10, bringing the toggle mechanism 8 into its flexed position, thereby relieving the brake arms 6 and moving the brake linings 7 to a sufficient distance from the guiderail 2. Not shown in the drawing is a device which uses screws to adjust the effective length of the extended toggle mechanism 8.

Figure 2:
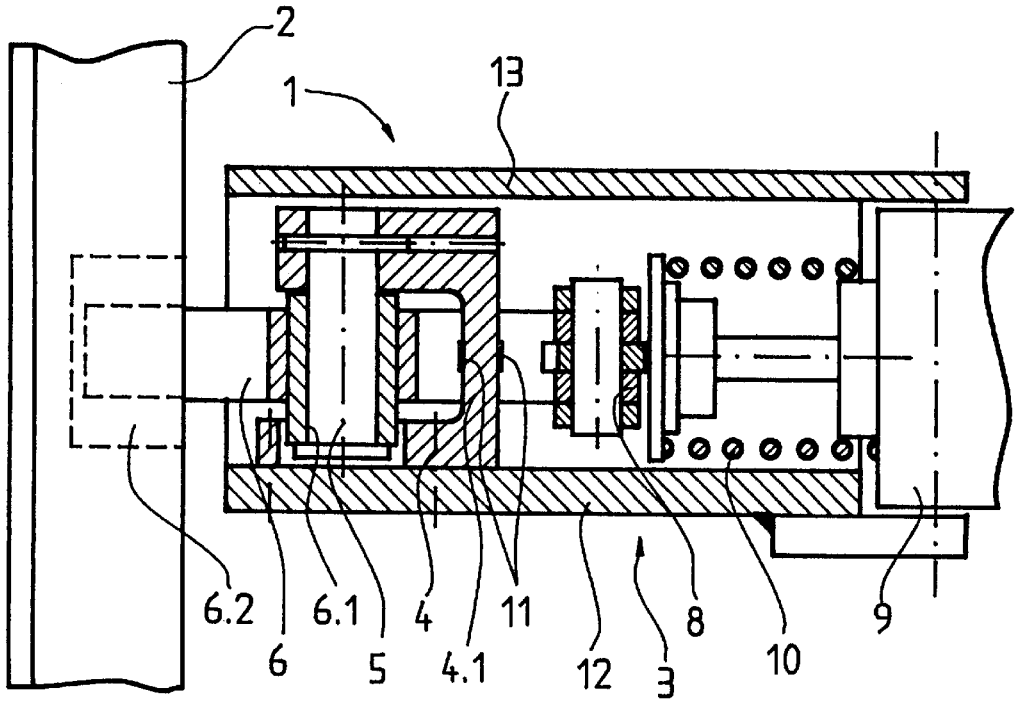
FIG. 2 is a side elevation view in cross-section through the car braking device shown in FIG. 1.

FIG. 2 shows a vertical cross section through the car braking device 1. Shown in the drawing are the car guiderail 2, a baseplate 12 and a cover plate 13 of the casing 3, the brake arm support 4 with one of the brake arm swivel bolts 5, one of the brake arms 6 with the brake arm hub 6.1 and brake shoe 6.2, and a cross-section through the toggle mechanism 8, the stroke-imparting mechanism 9, and the compression spring 10.

It can be seen from FIG. 2 how registering the holding forces is effected in the car braking device 1 according to the present invention. Vertically directed holding forces on the brake shoes 6.2 generate via the brake ends of the brake arms 6 and the brake arm swivel bolt 5 a bending moment on a vertical section 4.1 of the brake arm support 4 which generates in it tensile and compressive stresses which are essentially proportional to the holding forces which occur. An electronic interpretation circuit (not shown) detects these stresses with the assistance of the metal or semiconductor wire-resistance strain gages 11 which are fastened in a suitable manner onto the aforementioned vertical section 4.1 and form components of an electrical bridge circuit. With this arrangement a correctly signed value for upward or downward directed holding forces can be determined, which serves as information for the control and the drive regulator regarding the load present in the car. On the other hand, by detecting when the bridge circuit is in balance, it can be very accurately determined when no more vertical holding forces are present on the closed brake levers and the car braking device can therefore be opened without generating a jerk.

Figure 3:
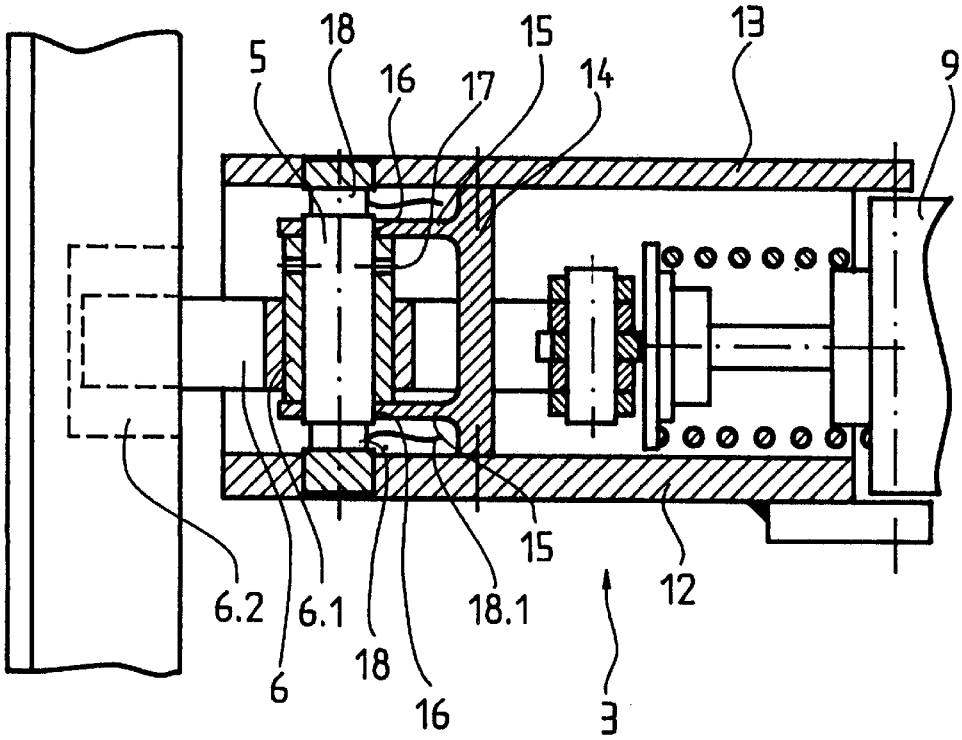
FIG. 3 is a side elevation view in cross-section, similar to FIG. 2, through an alternate embodiment car braking device according to the present invention.

FIG. 3 illustrates an alternative solution to the method described above of registering the holding forces acting on the car braking device 1. Substituted for the strain gages 11 are piezoelectric pressure sensors 18 and their connecting cables 18.1. Here the casing 3 contains, and has rigidly fastened to it, a metal guiderail support 14 which has two arms 15 in the form of plates each having in it two drilled holes 16 which serve as play-free guides for the brake arm swivel bolts S. The arms 15 act as a parallelogram guide for these bolts 5 which at one end are rigidly fastened with a pin 17 to the brake arm hub 6.1 of the brake arms 6 and at the other end are supported axially via piezoelectric pressure sensors 18 against the baseplate 12 and the cover plate 13. If there are now vertical holding forces acting on the brake shoes 6.2 they are compensated by parallel, oppositely acting supporting forces acting from the base or cover plate via the pressure sensors 18 on the brake arm swivel bolt 5. The moment on the brake arm swivel bolt is absorbed by horizontal supporting forces between the arms 15 and this bolt 5. As a result, only the vertical components corresponding to the holding forces are transmitted to the piezoelectric pressure sensors 18. An electronic circuit (not shown) interprets their pressure-dependent electrical characteristics and generates the information required by the elevator control and drive regulator.

Figure 4:
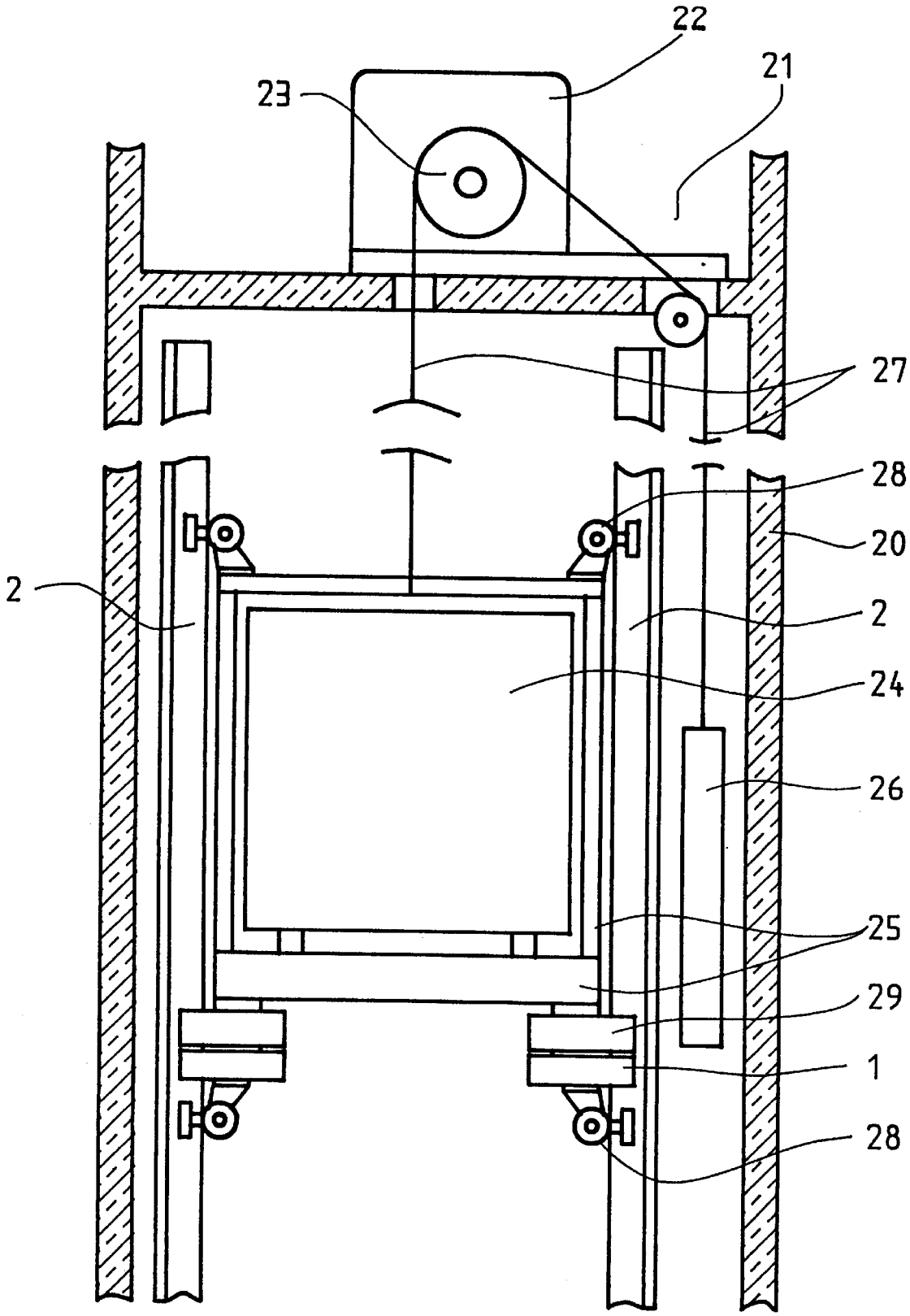
FIG. 4 is a schematic view of a typical elevator installation with two car braking devices according to the present invention built onto it.

FIG. 4 shows the application and installation in a normal elevator system of the car braking device 1 according to the present invention. An elevator hoistway 20 has installed in it vertically extending car guiderails 2, a machine room 21 at the top containing a drive unit 22 with traction sheave 23, an elevator car 24 carried in a car sling 25, a counterweight 26, and suspension means 27 which suspend and connect together the car and the counterweight and which are themselves driven by the traction sheave 23.

Fastened to the car sling 25 are roller guide assemblies 28 to guide the car 24 on the car guiderails 2, safety gears 29, and the car braking device 1 according to the present invention. These components are constructed in such a way that by means of suitable connecting pieces they can be flanged together one below the other in the form of a sandwich and onto the car sling 25. On very heavy cars, use of this technique makes it possible to install two or even more car braking devices one below the other.

Figure 5:
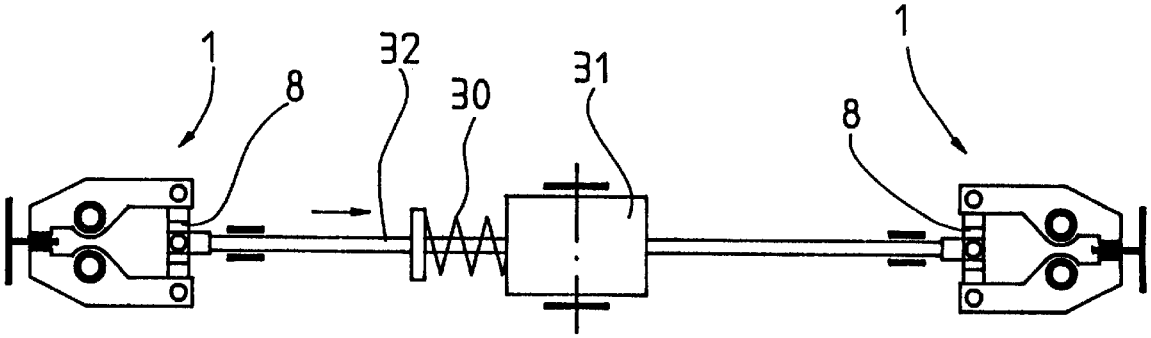
FIG. 5 is a top plan view of a two car braking devices according to the present invention actuated by a common stroke-imparting mechanism.

FIG. 5 shows an arrangement of two car braking devices 1 in which a common compression spring 30 actuates a connection rod 32 having opposite ends connected to the toggle mechanisms 8 of both braking devices, and a common stroke-imparting device 31 fastened to the car sling acts against the pressure spring 30 to release them, as a result of which synchronous functioning is assured and one-sided braking is ruled out.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A braking device for preventing vertical displacements and vertical vibrations of load carrying means of vertical conveyors while stopped at landings, the load carrying means being supported by elastic suspension means, comprising:

a casing for mounting on a load carrying means;

a pair of brake arms;

means for selectively moving said brake arms into and out of engagement with a guiderail; and load sensing means coupled to said brake arms whereby when said casing is mounted on a load carrying means adjacent a guiderail, said brake arms engage the guiderail by frictional engagement and said load sensing means generates a signal representing vertically directed holding forces which occur.

2. The device according to claim 1 wherein said load sensing means senses said vertically directed holding forces which occur in both upward and downward directions.

3. The device according to claim 1 wherein said load sensing means includes strain gages.

4. The device according to claim 1 wherein said load sensing means includes piezoelectric force sensors.

5. The device according to claim 1 including a stroke-imparting mechanism and a toggle mechanism connected between said brake arms and said stroke-imparting mechanism wherein selective actuation of said stroke-imparting mechanism releases said brake arms from engagement with the guiderail.

6. The device according to claim 5 wherein said stroke-imparting mechanism is one of a solenoid, a hydraulic cylinder and a spindle motor.

7. A vertical conveyor for carrying loads comprising:

a load carrying means;

a drive unit;

an elastic suspension means connecting said load carrying means to said drive unit for moving said load carrying means in a vertical direction adjacent a guiderail;

a braking device attached to said load carrying means for preventing vertical displacements and vertical vibrations of load carrying means of vertical conveyors while stopped at landings, said braking device frictionally engaging said guiderail when said load carrying means is stopped at a landing; and a load sensing means mounted on said braking device for generating to said drive unit a signal representing vertically directed holding forces which occur.

8. The conveyor according to claim 7 wherein said load sensing means includes one of strain gages and piezoelectric force sensors.

9. The conveyor according to claim 7 wherein said elastic suspension means is a rope of synthetic fibers.

10. A method of preventing vertical displacements and vertical vibrations of a load carrying means in a vertical conveyor while stopped at landings, the conveyor having at least one drive unit which can be regulated, a load carrying means with a braking device being guided by a guiderail, the load carrying means being suspended by an elastic suspension means, and while stopped at a landing the load carrying means is held fast on the guiderail by the braking device, comprising the steps of:

a. sensing magnitude and direction of vertically directed holding forces occurring in the braking device while engaged with the guiderail;

b. generating a signal to the drive unit representing the sensed magnitude and direction of the vertically directed holding forces;

c. controlling the drive unit in response to the signal to balance the load on the suspension means; and d. releasing the braking device from the guiderail.

11. The method according to claim 10 wherein step c, is performed by adjusting torque on a traction sheave of the drive unit, and thereby tensile force in the suspension means supporting the load carrying means, so that step d, is performed without the braking device being under load.

12. The method according to claim 10 wherein the signal has a plus or minus sign corresponding to a direction of the holding force and the drive unit applies a torque through a traction sheave to the suspension means to cause the holding force on the braking device to become zero.

* * * * *